United States Patent [19]

Harrison et al.

[11] Patent Number: 4,976,672

[45] Date of Patent: Dec. 11, 1990

[54] SQUARING FOLDED CONTAINER BLANKS

[75] Inventors: John R. Harrison; John R. Van Noy, both of Baltimore, Md.

[73] Assignee: The Ward Machinery Company, Cockeysville, Md.

[21] Appl. No.: 319,429

[22] Filed: Mar. 3, 1989

[51] Int. Cl.[5] ..... B31B 1/62

[52] U.S. Cl. ..... 493/130; 493/128; 493/131; 493/142; 493/147; 493/179; 493/181; 493/182

[58] Field of Search ..... 493/130, 131, 141, 142, 493/147, 179, 181, 182, 319, 417, 128

[56] References Cited

U.S. PATENT DOCUMENTS

| | | | |
|---|---|---|---|
| 1,986,857 | 1/1935 | Roberts et al. | 493/417 |
| 2,532,522 | 12/1950 | Staude | 493/179 |
| 2,931,277 | 4/1960 | La Bombard | 493/179 |
| 3,105,419 | 10/1963 | La Bombard | 493/141 |
| 3,122,069 | 2/1964 | Lopez . | |
| 3,299,614 | 1/1967 | Brickson | 493/179 |
| 3,620,138 | 11/1971 | Neal et al. . | |
| 4,159,109 | 6/1979 | Watson et al. . | |
| 4,295,841 | 10/1981 | Ward, Jr. . | |
| 4,614,512 | 6/1986 | Capdeboscq | 493/179 |

*Primary Examiner*—D. S. Meislin
*Assistant Examiner*—Jack Lavinder
*Attorney, Agent, or Firm*—Boyce C. Dent; Edward D. C. Bartlett

[57] ABSTRACT

A machine or machine section for squaring folded container blanks has a conveyor for conveying slotted and partially folded container blanks. A folding device completes folding of each container blank while being conveyed by the conveyor. A gauge plate is inserted in a slot in each of the slotted and partially folded container blanks. A mechanism moves the gauge plate in timed sequence with the conveyor, inserts the gauge plate in the slot before completion of folding of the respective blank in order to "square" the folded blank, and then withdraws the gauge plate from the slot. Overlapping flaps of each folded blank may be tacked together during "squaring" by drops of hot melt adhesive which subsequently hold the flat folded blanks square while the conventional slow drying water soluble glue dries. The "squaring" arrangement may be incorporated in a conventional gluer/folder machine.

21 Claims, 6 Drawing Sheets

SQUARING FOLDED CONTAINER BLANKS

FIELD OF THE INVENTION

This invention relates to squaring folded container blanks, for example slotted, creased and folded container blanks of corrugated paper board. The invention particularly relates to an apparatus for squaring and completing the folding of partially folded container blanks and a method for doing this.

BACKGROUND OF THE INVENTION

It is known to fold container blanks into a flat folded sleeve for storage and/or transportation Erected flapped boxes can readily be formed from these flat folded sleeves when it is time to place contents in the boxes. Such folding of container blanks and folding machines therefor are disclosed in Lopez U.S. Pat. No. 3,122,069; Watson et al U.S. Pat. No. 4,159,109; and Ward, Jr. U.S. Pat. No. 4,295,581; the disclosures of which are incorporated herein by reference. As part of this folding procedure, e.g. while the blanks are still flat before folding, liquid glue may be applied to a flap portion of each blank to subsequently glue two overlapping flap portions together in the flat folded sleeve state.

The flat folded sleeves are often out of "square". Stacks of the flat folded sleeves can be subjected to an edge beating or "spanking" procedure, while the glue is still wet, to effect "squaring" of the folded container blanks in the stack Also, while the glue (which is usually slow drying) is still wet, there is a tendency for the flat folded sleeves to want to unfold somewhat and start coming apart. This may be countered by pressing down on the above mentioned stacks, or compressing the stacks, until the glue has set.

Although the above squaring and pressing procedures are used with reasonable success, they are somewhat inconvenient and place some restrictions on the particular production line.

It has been suggested that a small quantity of more expensive quick drying adhesive can be used in combination with the cheaper slow drying glue; the quick drying glue "tacking" or "locking" the overlapping flaps together while the slow drying glue has time to dry. See, for example, Neal et al U.S. Pat. No. 20,138 which hot melt adhesive is used to tack overlapping flaps while cheaper water soluble adhesive sets. Over the years, this technique has not been adopted to reduce or overcome the above inconveniences and restrictions found in container blank gluing and folding production lines. This is possibly because in the folding production lines, the folding is completed and the glued surfaces contacted well in advance of the "squaring" operation by spanking.

SUMMARY OF THE INVENTION

The present invention is concerned with providing a new and improved method of "squaring" folded container blanks.

A particular aspect of the preferred embodiment of the present invention is inserting a gauge plate in a slot between overlapping flaps as the folding of the blank is completed.

This has the effect of causing the overlying panels of the folded blank to rotate or slew with respect to each other, as necessary, during the final folding to effect "squaring". This has the further advantage that it may readily be performed as an in-line operation with the blank folding operation.

Another aspect of the preferred embodiment is applying some quick, or virtually instant, setting adhesive to lock the folded blank "square" before the gauge plate is withdrawn.

Accordingly, therefore, there is provided by one aspect of the present invention an apparatus for squaring folded container blanks, comprising conveying means for accepting and conveying slotted and partially folded container blanks, folding means for completing folding of each container blank while being conveyed by the conveying means, and a gauge plate for insertion in a slot in a respective one of the slotted and partially folded container blanks. Moving means is provided for (a) moving the gauge plate in timed sequence with the conveying means, (b) inserting the gauge plate in the slot before completion of folding of the respective blank by the folding means in order to square the folded blank, and (c) withdrawing the gauge plate from the slot.

Conveniently, the conveying means may extend in and move the blanks in a longitudinal direction, and the gauge plate may be disposed and move in a vertical plane parallel to this longitudinal direction.

Preferably, there is a plurality of pairs of leading and trailing gauge plates, each pair engaging opposite ends of a respective blank.

Holding means may be provided, downstream of the folding means, for receiving completely folded blanks from the folding means and holding them completely folded as these blanks are moved through the holding means by the conveying means. The holding means may comprise a holding ramp which is spaced from and extends parallel to the conveying means.

According to another aspect of the present invention, there is provided an apparatus for squaring folded container blanks, comprising conveying means for conveying container blanks, gauge means for insertion in and gauging of a slot between overlapping flaps of a respective one of said container blanks, folding means for at least completing folding of each container blank while being conveyed by the conveying means, and inserting means for inserting the gauge means in the slot before completion of folding of the respective blank by the folding means in order to square the folded blank.

In either of the above aspects of the invention, means may be provided for applying adhesive to one of the flaps of each blank before completion of folding of the blanks.

According to yet another aspect of the present invention, there is provided a method of squaring folded container blanks, comprising the steps of partially folding container blanks to create partially folded blanks each having two overlapping flaps defining at least one slot therebetween, introducing a gauge plate in the slot of each respective blank before folding thereof has been completed, completing folding of the partially folded blanks, leaving the gauge plate inserted in the respective slot during completion of folding of the respective blank to effect squaring of the respective folded blank, and then withdrawing the gauge plate from the respective slot.

Preferably, the container blanks are continuously moved in a forward direction while the gauge plate introducing, completing folding, gauge plate leaving, and gauge plate withdrawing steps are performed.

It will be appreciated that the present invention can be incorporated in a machine section and placed in a production line after a conventional gluer/folder machine. However, it is contemplated that the application of the small quantity of quick setting or instant glue could, if desired, be performed in the gluer/folder machine by modification thereof.

It is also contemplated that the present invention could be fully incorporated in the gluer/folder machine so that all the folding, gluing and squaring operations are carried out in a single machine or machine section. In this respect, the completion of folding could be effected by folding bars in the same way as the conventional folding operation, even by the same folding bars used to form the partially folded blanks.

It will also be realized that the present invention could take the form of a separate, independent machine which is supplied with partially, or even fully, folded container blanks and delivers the blanks as "squared" flat folded sleeves.

Other objects, features and advantages of the present invention will become more fully apparent from the following detailed description of the preferred embodiment, the appended claims and the accompanying drawings.

BRIEF DESCRIPTION OF THE DRAWINGS

In the accompanying drawings, in which like reference characters in different FIGURES indicate like parts.

DETAILED DESCRIPTION OF THE PREFERRED EMBODIMENT

The preferred embodiment of the apparatus of the invention is illustrated in FIGS. 1 to 6 and 9. FIG. 7 shows a folded and glued container blank after leaving the apparatus of FIGS. 1 to 6, and FIG. 8 shows a partially folded container blank in a general configuration in which it would enter the apparatus of FIGS. 1 to 6.

Figure 1:
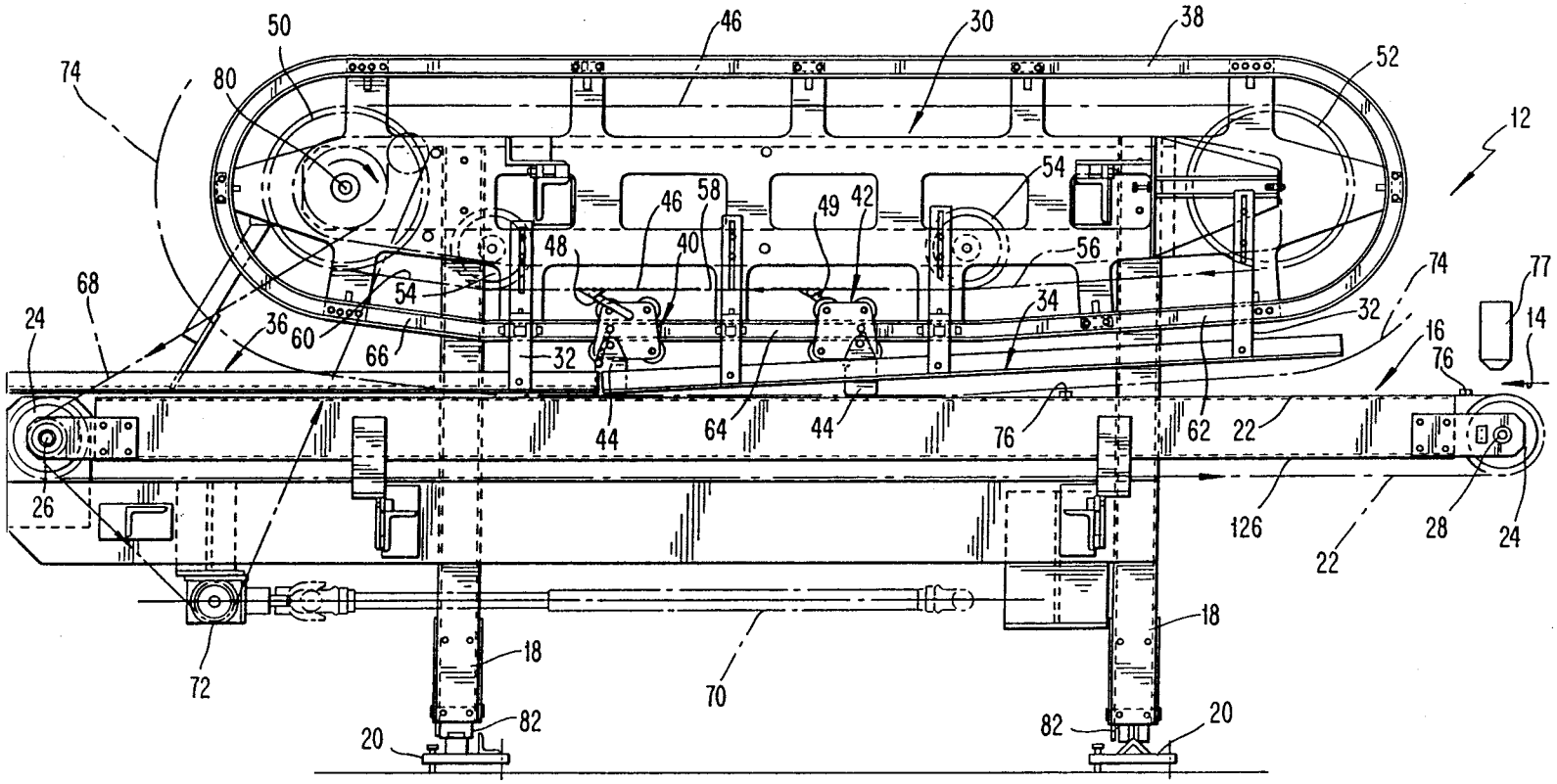
FIG. 1 is a diagrammatic side elevational view of an apparatus according to the invention for squaring and completing the folding of container blanks.

FIG. 1 is a side elevational view of a gauge-lock folder apparatus 12. Partially folded container blanks enter the apparatus at the righthand end in the direction of the arrow 14, and continue through the apparatus on an endless belt conveyor 16 until exiting as fully folded blanks at the lefthand end. The apparatus 12 has a frame structure with four vertical posts 18 standing on two transverse rails 20. The conveyor 16 includes an endless belt 22 entrained around pulleys 24 mounted on shafts 26, 28 at each end of the apparatus 12. An upper portion 30 of the frame structure extends lengthwise above the conveyor 16. Suspended by straps 32 from the frame portion 30 are a downwardly inclined folding ramp 34 and a holding ramp 36. Both ramps 34, 36 are above the upper flight of the conveyor belt 22, with the ramp 36 being parallel thereto and spaced thereabove by the thickness of a fully folded container blank. An endless track 38 surrounds and is supported by the upper frame portion 30. On this track 38 are movably mounted six pairs of gauge carrying carriages 40, 42 (for simplicity only one pair being shown). The six pairs of gauge carriages 40, 42 are equi-spaced around the track 38. Each carriage 40, 42 has four wheels, which are rotatably engaged in pairs on opposite edges of the track 38. Each carriage carries a gauge plate 44. The carriages 40, 42 are connected to two timing belts 46 (see also FIG. 2) by drag links 48, 49, respectively, pivoted at each end. The nearside timing belt 46 passes around end pulleys 50, 52 and intermediate lower pulleys 54. The intermediate pulleys 54 are arranged so that the lower flight of the timing belt 46 has first portion 56 substantially parallel to the downward inclination of the folding ramp 34, a middle portion 58 parallel to the conveyor 16 and the holding ramp 36, and a last portion 60 which inclines upwardly more steeply than the first portion 56 inclines downwardly. It will be observed that the lower run of the track 38 has three similar portions 62, 64, 66 substantially parallel to the three timing belt portions 56, 58, 60, respectively. The conveyor pulley shaft 26 and the timing belt pulley 50 are drivingly rotated from a double-sided timing belt 68 (illustrated in broken lines) which is driven from a main machine drive via a telescopic drive shaft 70 and a gearbox 72. The belt 68, timing belt 46 and conveyor belt 22 are driven in the direction of the arrowheads thereon. This causes the gauge carriages 40, 42 to move continuously around the track 38 with the radially outer ends of the gauge plates 44 following the path 74 (in broken lines). The conveyor belt 22 has a series of lugs 76 equi-spaced around its periphery. These lugs successively engage the trailing edge of partially folded blanks fed to the apparatus 12 from a folder/ gluer machine. The lugs 76 are spaced apart a distance corresponding to the constant repeat lengths at which the blanks enter the apparatus 12 which is greater than the length of the folded blank. A hot melt glue extruder unit 77 is mounted over the beginning of the conveyor 16 on a bracket 79 (see FIG. 3) extending rearwardly from the upstream end of the frame portion 30.

Figure 2:
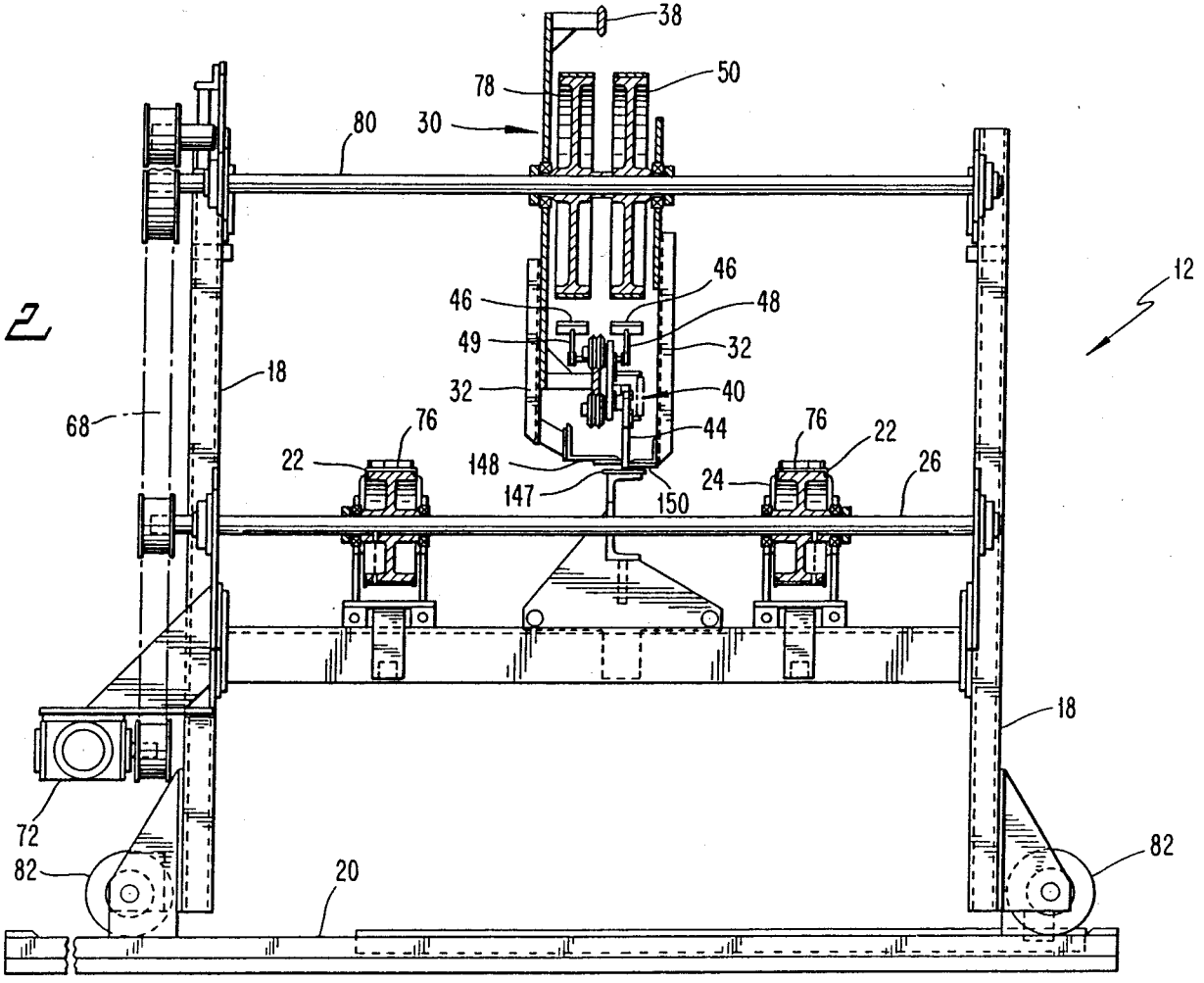
FIG. 2 is a front elevational view of the apparatus from the left in FIG. 1.

FIG. 2 is a front elevational view from the left in FIG. 1 with some parts omitted and some parts shown in section for simplicity and clarity. As can be seen, the endless belt conveyor has two endless belts 22 spaced apart laterally between the posts 18. The upper frame portion 30 is spaced between the two belts 22. A second timing belt drive pulley 78 is spaced a short distance laterally from the timing belt pulley 50 on the same drive shaft 80. The second timing belt 46 is driven by the pulley 78, FIG. 2 clearly showing the pair of timing belts 46 located side by side a short distance apart transversely. Whereas the drag links 48 of the gauge carriages 40 are pivoted to and drawn by the righthand belt 46 in FIG. 2, the drag links 49 of the gauge carriages 42 are pivoted to and drawn by the lefthand belt 46. However, the wheels of all the carriages 40, 42 engage on the same track 38 which transversely is disposed between the pulleys 50, 78 and the pair of belts 46. The gearbox 72 and the drive belt 68 with its associated pulleys can be seen on the lefthand side in FIG. 2. The bottoms of the four frame posts 18 are supported on the tracks 20 by wheels 82 to enable the apparatus 12 to be moved laterally on the pair of tracks 20; this is to correctly locate the plane of the gauge plates 44 as will be explained later. To accommodate different size carton blanks, the lateral spacing between the endless conveyor belts 22 is adjustable as is the lateral position of the pair of belts 22 with respect to the central frame 30.

Figure 3:
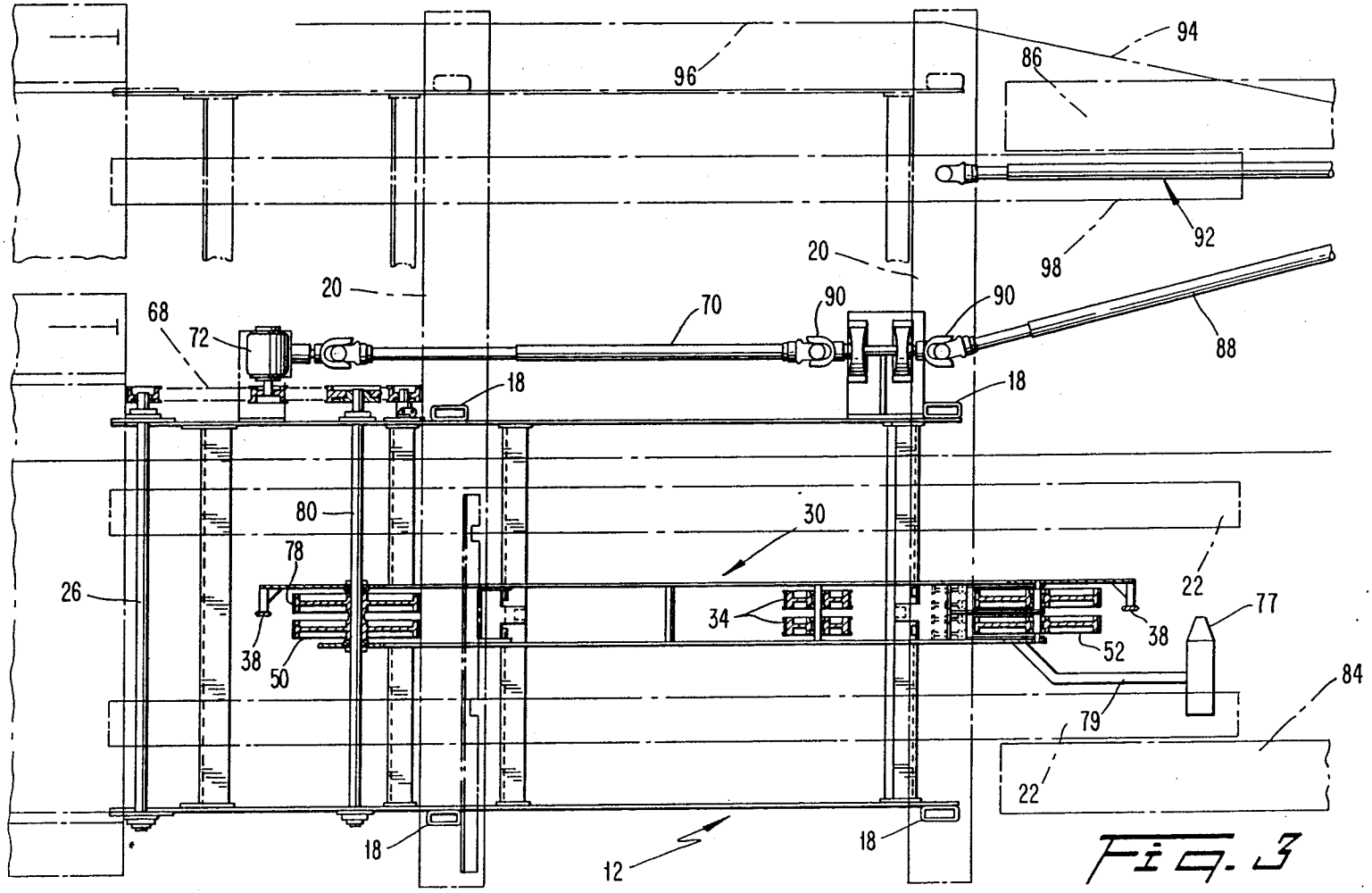
FIG. 3 is a top plan view of the apparatus of FIG. 1 also showing in phantom a laterally adjusted position and on the righthand side the delivery end of a conventional gluer/folder machine.

FIG. 3 is a top plan view of the apparatus 12 with a number of parts omitted and other parts shown in broken lines for contrast, simplicity and clarity. The pair of rails 20, on which the apparatus is adjustably movable laterally (i.e. up and down in FIG. 3), are shown in broken lines. The discharge ends of a pair of conveyor belts 84, 86 of a gluer/folder machine are shown in broken lines on the right side in FIG. 3. The folder belt 84 can be seen extending side by side for a distance with one on the conveyor belts 22. This overlap of these belts ensures a smooth transfer of folded blanks from the gluer/folder machine, and enables the lugs 76 (see FIG. 1) to engage and drive each successive folded blank in timed relation to the operation of the apparatus 12. A telescopic drive shaft 88 is drivingly connected to the drive shaft 70 via universal couplings 90. The drive shaft 88 is driven from the drive of the gluer/folder machine or from a main drive for the particular production line. When the apparatus 12 is moved along the tracks 20, the drive shaft 88 swings horizontally, telescoping as necessary to adjust its length. An intermediate position of the drive shaft 88 is shown at 92, this being when the apparatus 12 has travelled about halfway along the rails 22. When the apparatus 12 has travelled the full length of the rails 22 to an extreme position (upper position in FIG. 3), the drive shafts 88, 70 are shown in broken lines at 94, 96, respectively; also, in this position the position of the upper conveyor belt 22 can be seen at 98 along side the discharge end of the folder belt 86. The apparatus 12 is releasably locked on the tracks 20 in the selected lateral position. The hot melt extruder unit 77 moves laterally with the gauge-lock folder 12 due to the bracket 79. The unit 77 operates in timed relation with the timed conveyor belts 22 to extrude drops of hot melt adhesive onto predetermined locations on a flap of a container blank being processed, as will be more fully described later.

Figure 4:
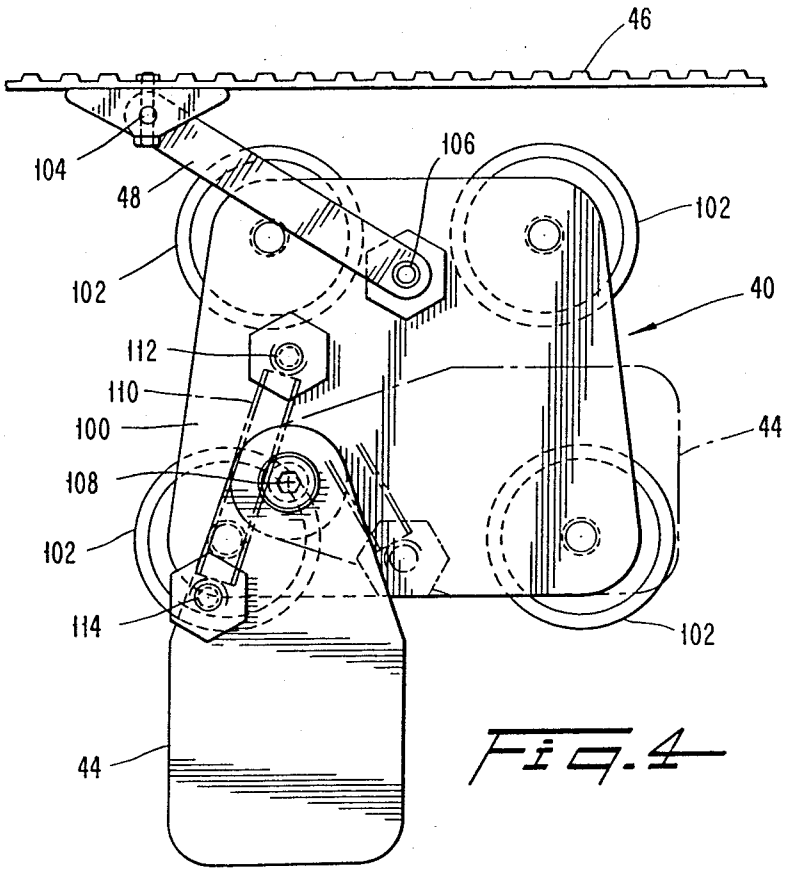
FIG. 4 is a side elevational view in greater detail of one of the gauge carriages of the apparatus of FIGS. 1 to 3.

FIG. 4 is a side elevational view of the gauge carriage 40 in the same position as in FIG. 1 but on a larger scale. The carriage 40 has a somewhat rectangular main plate 100 which has wheels 102 rotatably mounted adjacent its four corners. These are the four grooved wheels which run on the track 38 (not shown in FIG. 4). The ends of the drag link 48 are pivotally attached at 104 to the belt 46 and at 106 to the plate 100. The gauge plate 44 is pivotally attached at 108 to the plate 100. The gauge plate 44 is biased by a tensioned coil spring 110 (shown in broken lines) into the downwardly extended position shown against a stop (shown in FIG. 5). The spring 110 is connected between a pin 112 on the plate 100 and a pin 114 on and to one side of the gauge plate 44. The spring is positioned to effect an over-center arrangement with respect to the pivot 108. Consequently, should the gauge plate 44 inadvertently strike anything during forward motion of the carriage 40, rearward force on the gauge plate 44 can overcome the spring bias and pivot the plate 44 rearwardly (anticlockwise in FIGS. 1 and 4). When the line of the spring 110 has moved over-center with respect to the pivot 108, the spring will retract the gauge plate to the position shown in broken lines. The gauge plate can then be manually pivoted clockwise back to its full line operative position. The other gauge carriage 42 is similarly constructed. Each gauge carriage 40 is a leading carriage with a leading gauge plate 44, and each gauge carriage 42 is a trailing carriage with a trailing gauge plate 44. Each pair of gauge carriages 40, 42 operate upon the respective leading and trailing ends of a folded container blank as will be explained later.

Figure 5:
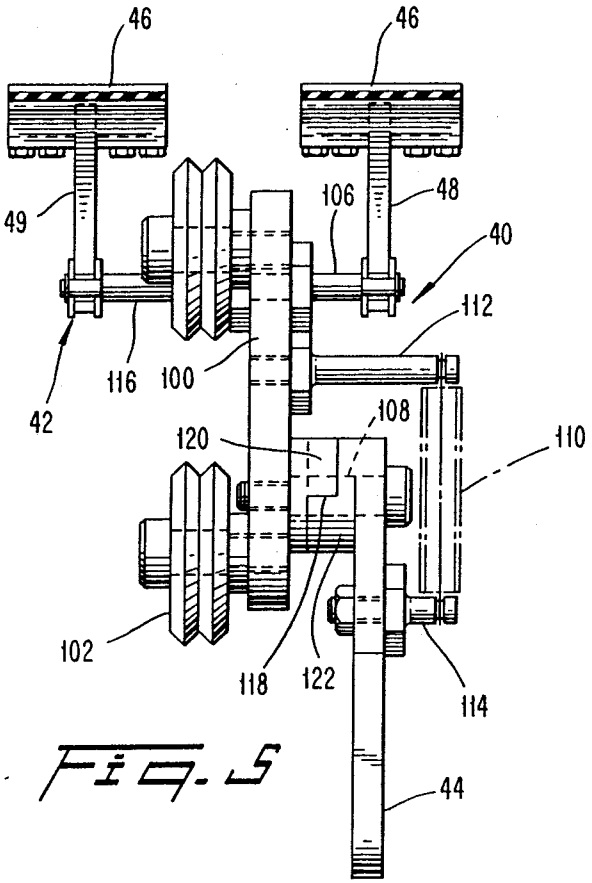
FIG. 5 is a front view of the gauge carriage of FIG. 4 from the lefthand side of FIG. 4.

FIG. 5 shows a front view of the leading gauge carriage 40 from the left in FIGS. 1 and 4, and also shows a part of the trailing gauge carriage 42 behind the carriage 40 together with both timing belts 46. The plate 100 is disposed vertically between the pair of belts 46. The grooved wheels 102 can be seen on the left of the plate 100, but also between the pair of belts 46. The pivot 106 extends to the right of the plate 100 and the drag link 48 extends vertically upwards from the outer end of the pivot 106 to the center of the underside of the righthand belt 46. The trailing gauge carriage 42 is behind and hidden from view in FIG. 5 by the leading carriage 40, except for the drag link 49 and its lower pivot 116. Pivot shaft 116 of the trailing carriage 42 corresponds to pivot 106 of the leading carriage 40, except the pivot 116 extends from the plate 100 in the opposite direction to the pivot 106. This places the drag link 49 of the trailing carriage on the left side of the plate 10below the lefthand belt 46. Thus, the leading gauge carriages are positioned and moved by the right-hand (in FIG. 5) timing belt 46 and the trailing gauge carriages are positioned and moved by the lefthand (in FIG. 5) timing belt 46. By adjusting the rotational orientation of the timing belt drive pulleys 50 and 78 (see FIG. 2) relative to each other and their common drive shaft 80, the spacing between and the timing of the leading and trailing carriages 40, 42 can be adjusted and set. For this purpose, the pulleys 50, 78 are each separately adjustably secured on the shaft 80, and the rear pulleys 52 (see FIG. 1) are both freely rotatably mounted on their shaft. Returning to FIG. 5, engaging shoulders 118 respectively formed on a boss 120 on the carriage plate 100 and a boss 122 on the gauge plate 44 provide the previously mentioned stop for limiting pivoting movement of the gauge plate 44 by the spring 100 in the extended operative position.

Figure 6:
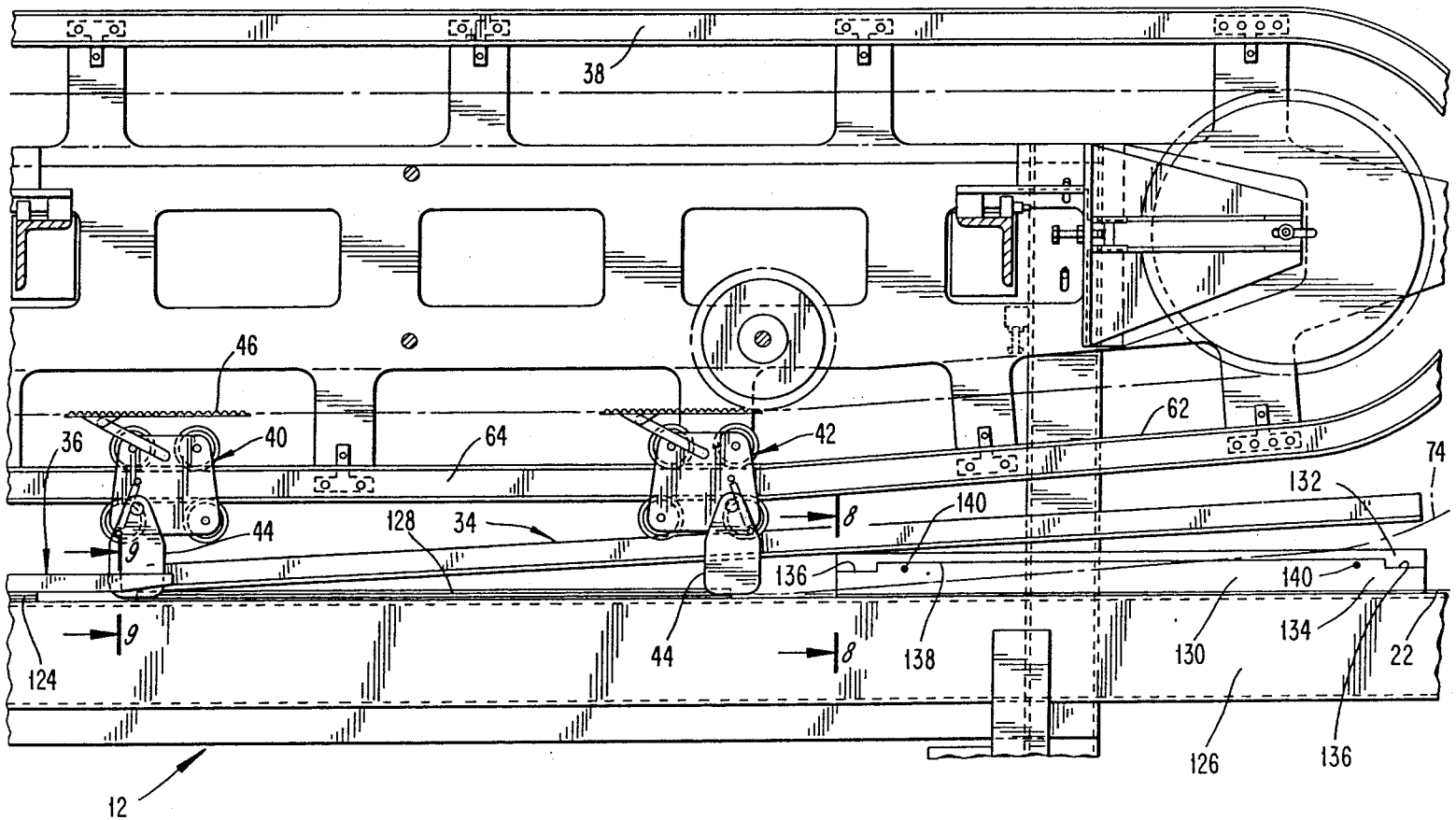
FIG. 6 is an enlarged portion of FIG. 1 illustrating the completion of folding of folded and glued container blanks.
Figure 7:
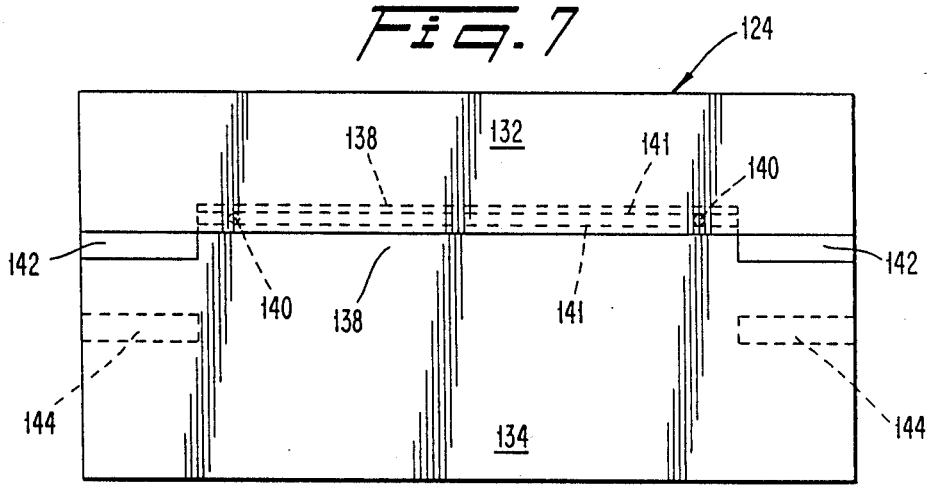
FIG. 7 is a top plan view of a fully folded and glued container blank.

FIG. 6 is a portion of FIG. 1, but on a larger scale and illustrating the completion of folding of previously glued and partially folded container blanks. On the left in FIG. 6 can be seen the trailing end of a fully folded blank 124 held fully folded by the holding ramp 36. The blank 124 is held between the holding ramp 36 and a central part of the conveyor 16 intermediate the belts 22 for the length of the holding ramp 36 (see FIG. 1); this enables any "memory" in the folded blank to be dissipated or at least be weakened. Then, when the flattened folded blank 124 emerges from the downstream end of the holding ramp 36, this folded blank will resist the tendency to open up and try to unfold. Also, the length of the holding ramp 36 ensures that the fast or instant setting hot melt glue is firmly set before the fully folded blank emerges from under the holding ramp 36. The length of the holding ramp is at least as long as, and preferably longer than, the length of the folded blanks.

Figure 9:
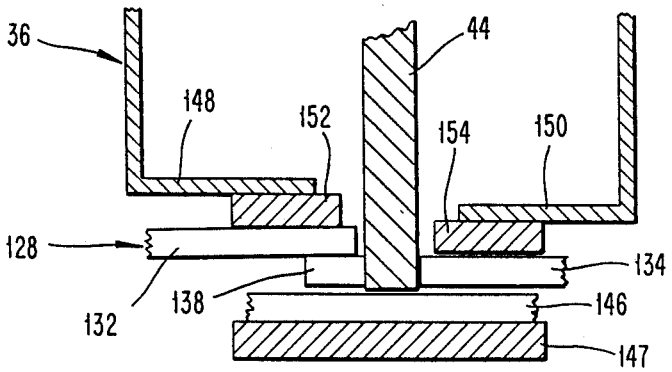
FIG. 9 is a section taken on the line 9–9 of FIG. 6.

The upper flights of the pair of conveyor belts 22 run over, and are supported against deformation by, platforms 126. The holding ramp 36 has a cooperating underneath support surface (which is shown in FIGS. 2 and 9 and will be described further later) approximately level with the top of platforms 126 to enable the blank 124 to be held folded flat and slightly squeezed while passing under the holding ramp 36. A folded blank 128 is shown entering under the holding ramp 36, this blank 128 having been fully folded by the steadily increasing compression effect of the folding ramp 34 as the partially folded blank moved along thereunder. The gauge plates 44 of the leading and trailing gauge carriages 40, 42 can be seen engaged in the leading and trailing portions of the folded blank 128. This "squares" the folded blank before the glue fully sets as will be described more fully later. A partially folded blank 130 is shown partway along the folding ramp 34 with the leading end of the blank 130 having contacted the underside of the folding ramp 34. The partially folded blank 130 is in approximately the folded condition in which it was transferred from the gluer/folder machine to the gauge-lock folder 12. The folding ramp 34 has just started to further fold the partially folded blank 130 towards the fully folded state. The lugs 76 (see FIG. 1) on the conveyor belts 22 forcibly slide the blank under the downwardly and forwardly inclined lower surface of the folding ramp 34 as the belts 22 advance.

The partially folded blank 130 has two loosely overlapping —but still spaced apart—flaps 132, 134. The flap 134 has been previously slotted to form cutouts 136 at each end which define a glue flap 138 therebetween, this glue flap 138 forming an extension of the flap 130. A spot 140 of hot melt glue can be seen located adjacent each end of the glue flap 138 on the upper surface thereof. This has been applied by the hot melt extruder 77 (see FIGS. 1 and 3).

Although not shown in FIG. 6 for simplicity, a pair of leading and trailing gauge carriages 40, 42 would be located adjacent the ends of the partially folded blank 130. The gauge plate of the leading carriage would be engaged through the leading cutout 136, and the gauge plate of the trailing carriage would be above and shortly to enter the trailing cutout 136. The elevation of these gauge plates relative to the blank 134 can be appreciated from the broken line path 74 of the radially outer edges of the gauge plates. Thus, even in the position of the blank 130, a leading gauge plate will have started its function of squaring the folded blank before the spots 140 of hot melt glue effectively lock the folded disposition of the blank.

FIG. 7 is a plan view of the fully folded container blank 124. This can have been formed from corrugated paperboard on, for example, a flexographic slotter creaser machine and then glued and folded on a conventional gluer/folder machine, before having the hot melt glue spots applied, and then squared and folded fully flat on the gauge-lock folder 12. The glue flap 138 can be seen partially passing below the flap 132 to which it is secured by the two spots 140 of hot melt adhesive. Lines 141 of water soluble slow drying adhesive form the main adhesion between the flaps 132, 138. These lines 141 of slow drying adhesive are applied to the underside of the flap 132 while the carton is being folded in the gluer/folder machine, this being done in a manner which is well known in this art. Only partially placing the glue flap 138 below the flap 132 causes the cutouts 136 (FIG. 6) to create leading and trailing slots 142. Underneath the slots 142 is a layer of paperboard forming another panel of the folded container blank. As is well known, this other panel usually has a pair of slots 144 therein which correspond to the slots 142 but are laterally displaced therefrom. Only if a square-sectioned box were being made from the container blank would the slots 144 coincide with the slots 142 in the folded blank 124. The gauge plates 44 engage in the slots 142 to square and hold the folded blank square, the thickness of the gauge plates 44 preferably being the same as, or slightly less than, the width of these slots 142.

Figure 8:
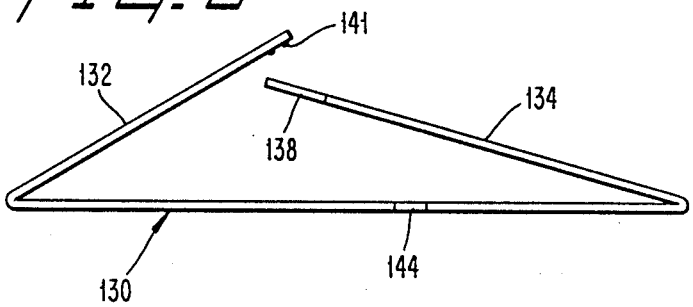
FIG. 8 is a view taken on the line 8–8 of FIG. 6 of a glued and partially folded container blank.

FIG. 8 is an end view of the partially folded blank 130 taken on the line 8-8 in FIG. 6. The free end of the flap 132 is uppermost and partially overlaps the glue flap 138. However, the free end of the flap 132 is spaced above and away from the glue flap 138. This disposition of the partially folded blank 130 can be obtained by appropriately adjusting the folding bars etc. of the conventional folding machine on which blank 130 is folded In this way the stripes 141 of slow drying glue on the underside of the flap 132 do not contact the glue flap 138 before the folded blank 130 enters the folding ramp 34 of the gauge-lock folder 12. This allows initial squaring action of the folded blank 130 by the gauge plates 44 to occur before the glue 141 on the flap 132 contacts the glue flap 138, and before the placed spots 140 of hot melt adhesive contact the flap 132.

FIG. 9 is a diagrammatic section on the line 9-9 through the holding ramp 36 and the gauge plate 44 of the leading gauge carriage 40, and showing a fragment of the leading end of the just fully folded blank 128. The lower end of the gauge plate 44 can be seen engaged in the leading slot defined between the upper flaps 132, 134, that is the lefthand slot 142 in FIG. 7. The underneath panel 146 of the folded blank is disposed between the bottom edge of the gauge plate 44 and the previously mentioned underneath support surface of a support rail 147 forming a central member of the conveyor 16 (see also FIG. 2). The holding ramp 36 is formed by two inwardly directed angle irons 148, 150 (see also FIG. 2) with the gauge plate 44 extending freely down between the inturned flanges of the angle irons 148, 150. These inturned flanges have friction resistant plastic pads 152, 154 secured to their undersides. These pads 152, 154 contact the blank flaps 132, 134, respectively, and facilitate sliding of the blank relative to the holding ramp 36. The pads 152, 154 also reduce the risk of abrading or otherwise damaging the flaps 132, 134. As can be clearly seen, the angle iron 148 and its pad 152 are at a slightly higher level than the angle iron 150 and its pad 154. This is to compensate for the different thickness of paperboard on each side of the gauge plate 44. On the lefthand side of the gauge plate 44 in FIG. 9 are three layers of thicknesses of paperboard, made up of the underneath panel 146, the glue flap 138, and the free end of the upper flap 132. Whereas on the righthand side of the gauge plate 44 in FIG. 9 there are only two layers of paperboard, namely the underneath panel 146 and the flap 134. Thus, the pad 152 is spaced above the pad 154 by the thickness of the paperboard sheet from which the blank is made. To accommodate different sheet thicknesses, the angle irons 148, 150 are independently adjustable vertically relative to the central frame portion 30. The lower end of the folding ramp 34 merges into the beginning of the holding ramp 36. The folding ramp 34 is similarly made of a pair of angle irons, with one spaced above the other and faced with friction resistant pads.

In operation, previously printed, slotted, and creased blanks are folded and glued in a conventional folding machine. The folding machine is adjusted to only partially fold the blanks to the condition in FIG. 8. The conventional stripes 141 of slow drying glue are applied to one flap, preferably outer flap 132. As is well known, for cost reasons a water soluble glue, which is slow drying, is usually employed. To prevent the folded and glued blank distorting while this slow drying glue is setting, spots of fast (or virtually instant) setting hot melt adhesive are also applied to at least one of the open flaps. When the blank is fully folded, these spots of hot melt adhesive virtually instantaneously lock the two overlapping glued flaps together; this tacks the fully folded blank in position while the slow drying glue has time to fully dry. The main strength in the glued joint comes from the slow drying glue.

The spots of hot melt glue are conveniently applied by intermittent ejection from one or more extruders 77 at the beginning of the gauge-lock folder 12. However, the spots of hot melt adhesive could be applied in the gluer/folder machine by suitable modification thereof. As will be appreciated, any commercially available hot melt adhesive extruders 77 can be employed. Also, the control system for such extruders would be synchronized with the main machine drive, and timed with the position of the blank conveying lugs 76, to ensure the desired size and positioning of the spots 140 on the glue flap (or the flap 132 if desired).

As the folded blanks pass under, and folding is being completed by, the folding ramp 34, the gauge plates enter the central slots in the upper overlapping flaps 132, 134 and effectively "square" the folded blanks. Depending upon the configuration of the blank being folded, the gauge-lock folder 12 is moved transversely on the rails 20 until the gauge plates 44 are in the vertical plane along which the slots 142 should lie, when the blank is correctly and accurately fully folded. This is determined also by the lateral position of the slots 142 as the folded blanks leave the gluer/folder machine on conveyor 84 and/or 86. The apparatus 12 is secured in this adjusted position.

The thickness of the gauge plates 44 is equal to or slightly less than the correct width of the slots 142. Entry of the gauge plates 44 into the slots 142 is facilitated by effecting this while the folded blank is partially open in approximately the configuration in FIG. 8 and at 130 in FIG. 6. The leading gauge plate enters the leading slot 142 first; as one or both of the lengthwise edges of this slot 142 are contacted by the sides of the leading gauge plate 44, the upper and lower layers of the folded blank 130 are caused to turn, or slew, relative to each other as necessary until the slots 142 align with the vertical plane of the leading gauge plate 44. The trailing gauge plate 44 enters the trailing slot of the folded, but still partially open, blank 130; the trailing gauge plate performs a similar function and reinforces the action of the leading gauge plate. As the blank is more fully folded, this "squaring" operation on the blank operates to more accurately square the folded blank; also, the width of each slot 142 is forced to be at least equal to the thickness of the gauge plate, in other words the slots are gauged. When the fully folded blank 124 passes under the holding ramp 36, it has been fully squared and the gauge plates 44 are withdrawn, the leading gauge plate first, then the trailing gauge plate. This movement of the gauge plates can be appreciated from FIGS. 1 and 6.

At some point during the folding of the blank 130 under the folding ramp 34, the spots 140 of hot melt adhesive on the glue flap 138 will contact the upper flap 132, and the stripes of slow drying glue on the upper flap 132 will contact the glue flap 138. As soon as the spots 140 contact, there will be almost instant strong adhesion between the two flaps 132, 134 at these spots. This occurs after the leading gauge plate 44 has entered and at least started squaring the leading slot 142. At this stage, the trailing gauge plate 44 will have entered and may be further squaring the trailing slot 142. However, for a second or so after the spots 140 adhere, it is still possible to have some small degree of sliding, particularly twisting or skewing, movement of the flaps 132, 134 relative to each other. Thus, any final squaring action by the leading gauge plate 44 in the leading slot 142 and the trailing gauge plate 44 in the trailing slot 142, as the blank 130 is folded completely flat, will still be effective to more fully square the folded blank before the spots 140 of hot melt adhesive firmly lock the flaps 132, 134 together. It should be noted that preferably both gauge plates 44 should be in their lowermost position through the leading and trailing slots 142 before the folded blank 130 reaches the downstream end of the folding ramp 34, i.e. before the position 128 is reached in FIG. 6. Setting of the hot melt adhesive locks the fully folded blank 128 in its squared orientation while the slow drying, but stronger, glue in the stripes 141 dries and sets; the setting of the hot melt adhesive should be completed before the fully folded blank exits from the holding ramp 36.

When the fully folded blanks 124 exit from the gauge-lock folder 12, these folded blanks should remain squared and be capable of being readily handled, whether or not the stripes of slow drying glue 141 have completely dried and set.

The above described embodiments, of course, are not to be construed as limiting the breadth of the present invention. Modifications, and other alternative constructions, will be apparent which are within the spirit and scope of the invention as defined in the appended claims.

What is claimed:

1. Apparatus for squaring folded container blanks, comprising:

conveying means for accepting and conveying slotted and partially folded container blanks;

folding means for completing folding of each container blank while being conveyed by said conveying means;

a gauge plate for insertion in a slot in a respective one of said slotted and partially folded container blanks; and moving means for:

(a) moving said gauge plate in timed sequence with said conveying means, (b) inserting said gauge plate in said slot before completion of folding of the respective blank by said folding means in order to square the folded blank, and (c) withdrawing said gauge plate from said slot.

2. The apparatus of claim 1, wherein said conveying means extends in and moves said blanks in a longitudinal direction, and said gauge plate is disposed and moves in a vertical plane parallel to said longitudinal direction.

3. The apparatus of claim 1, further comprising a pair of such gauge plates, both of said gauge plates being moved by said moving means with one of said gauge plates leading the other of said gauge plates, and said moving means inserting said one gauge plate in a slot in a leading portion of said respective blank and said other gauge plate in a different slot in a trailing portion of said blank.

4. The apparatus of claim 3, wherein said pair of gauge plates are disposed in a common vertical plane.

5. The apparatus of claim 3, wherein said gauge plates are carried by carriages, and said moving means includes a closed track around which said carriages are moved.

6. The apparatus of claim 5, wherein said track has a first section which approaches said conveying means for said gauge plate inserting, a second section which extends parallel to said conveying means, and a third section which diverges from said conveying means for said gauge plate withdrawing.

7. The apparatus of claim 1, further comprising holding means, downstream of said folding means, for receiving completely folded blanks from said folding means and holding them completely folded as these blanks are moved through the holding means by said conveying means.

8. The apparatus of claim 7, wherein:

said folding means comprises a folding ramp which is inclined towards said conveying means in a direction said conveying means conveys said blanks; and said holding means comprises a holding ramp which is spaced from and extends parallel to said conveying means.

9. The apparatus of claim 8, wherein said moving means effects said gauge plate inserting while the respective blank is located between said folding ramp and said conveying means, and said moving means effects said gauge plate withdrawing while the respective blank is disposed between said holding ramp and said conveying means.

10. The apparatus of claim 9, wherein said conveying means comprises at least one endless conveyor belt.

11. The apparatus of claim 1, further comprising means for applying adhesive to said blanks while partially folded and before folding is completed by said folding means.

12. The apparatus of claim 11, wherein said applying means comprises a hot melt adhesive extruder.

13. Apparatus for squaring folded container blanks, comprising:

conveying means for conveying container blanks;

gauge means for insertion in and gauging of a slot between overlapping flaps of a respective one of said container blanks;

folding means for at least completing folding of each container blank while being conveyed by said conveying means; and inserting means for inserting said gauge means in said slot before completion of folding of the respective blank by said folding means in order to square the folded blank.

14. The apparatus of claim 13, further comprising means for applying adhesive to one of said flaps before said completion of folding.

15. The apparatus of claim 14, further comprising holding means, located immediately downstream of said folding means, for holding the respective blank completely folded with said adhesive sandwiched between said overlapping flaps.

16. The apparatus of claim 15, wherein said conveying means conveys said blanks successively past said adhesive applying means, said folding means, and said holding means.

17. The apparatus of claim 16, wherein:

said conveying means comprises an endless belt conveyor;

said folding means comprises a folding ramp converging towards said endless belt conveyor;

said gauge means comprises a gauge plate;

said inserting means comprises a carriage carrying said gauge plate and an endless track around which said carriage is moved;

said adhesive applying means comprises a hot melt adhesive extruder; and said holding means comprises a holding ramp extending parallel to said conveying means.

18. Apparatus, comprising:

a conveyor extending in a lengthwise direction for supporting and moving folded container blanks through the apparatus in a forward direction;

a folding ramp inclined towards said conveyor in said forward direction for engaging and completing folding of the container blanks when in a partially folded state with overlapping flaps;

an endless track spaced above said conveyor and extending at least part way along said conveyor;

a plurality of pairs of gauge carriages movable by belts around said track, each said pair comprising a leading gauge carriage spaced in front of a trailing gauge carriage;

each gauge carriage having a gauge plate extending outwardly therefrom in a vertical plane;

said track having a lower run which, in said forward direction, has a section which extends towards said conveyor for inserting each gauge plate in a slot defined between said overlapping flaps of a respective partially folded blank, and which has a subsequent section which diverges away from said conveyor for withdrawing each gauge plate from the respective slot;

said subsequent withdrawing section being disposed in said forward direction downstream of said folding ramp; and timing means for timing the movement of said gauge carriages in relation to conveying movement of said conveyor cause the gauge plates of each said pair of gauge carriages to engage in leading and trailing slots defined between the overlapping flaps of the respective blank to effect squaring of that blank as folding thereof is completed by said folding ramp.

19. The apparatus of claim 18, wherein:

said gauge plates are pivotally mounted on said gauge carriages with an over-center spring arrangement that resiliently holds the gauge plates in their extended position but allows any gauge plate to yield if struck and be resiliently pivoted to a retracted position; and further comprising:

a holding ramp extending downstream from said folding ramp parallel to said conveyor and spaced from said conveyor a distance equal to the thickness of each completely folded blank upon exiting from the holding ramp.

20. A method of squaring folded container blanks, comprising the steps of:

partially folding container blanks to create partially folded blanks each having two overlapping flaps defining at least one slot therebetween;

introducing a gauge plate in the slot of each respective blank before folding thereof has been completed;

completing folding of said partially folded blanks;

leaving the gauge plate inserted in the respective slot during completion of folding of the respective blank to effect squaring of the respective folded blank; and then withdrawing the gauge plate from the respective slot.

21. The method of claim 20, wherein the container blanks are continuously moved in a forward direction while said gauge plate introducing, completing folding, gauge plate leaving, and gauge plate withdrawing steps are performed.

* * * * *